United States Patent [19]

Azzato

[11] Patent Number: 4,974,877

[45] Date of Patent: Dec. 4, 1990

[54] COVER BINDER SYSTEM

[76] Inventor: Robert N. Azzato, 2217 E. Nicolet Ave., Phoenix, Ariz. 85020

[21] Appl. No.: 437,179

[22] Filed: Nov. 16, 1989

[51] Int. Cl.[5] ..... B42D 7/00

[52] U.S. Cl. ..... 281/47; 281/50; 412/902; 412/4; 412/9

[58] Field of Search ..... 412/4, 5, 15, 18, 19, 412/1, 9, 902, 17; 281/45, 46, 47, 50

[56] References Cited

U.S. PATENT DOCUMENTS

| | | | |
|---|---|---|---|
| 273,223 | 2/1883 | Carter | 281/47 |
| 1,474,494 | 11/1923 | Schade | 281/47 |
| 1,530,130 | 3/1925 | Lloyd | 281/47 |
| 1,665,128 | 4/1928 | Cather | 402/25 |
| 1,981,280 | 11/1934 | Osuch | 129/1 |
| 2,316,209 | 4/1943 | Zalkind | 401/25 |
| 2,950,821 | 8/1960 | Hoofer | 402/25 |
| 3,757,389 | 9/1973 | Wiland | 402/25 |
| 4,352,583 | 10/1982 | Errichiello | 281/45 |
| 4,369,013 | 1/1983 | Abildgaard | 412/38 |
| 4,561,623 | 12/1985 | Shepherd et al. | 248/447 |
| 4,624,480 | 11/1986 | Marthaler et al. | 281/49 |
| 4,645,237 | 2/1987 | Squire et al. | 281/47 |

*Primary Examiner*—Frank T. Yost
*Assistant Examiner*—Thomas Hamill, Jr.
*Attorney, Agent, or Firm*—Charles E. Cates

[57] ABSTRACT

The invention is a cover binder including a one piece cover, a one piece plastic strip adapted to pierce the spine of a book and a means for engaging the strip to the cover, and a method and an apparatus for binding books in the cover binder as by providing a plastic strip with at least one leg, piercing the spine of the book from within by the leg of the strip, passing the leg through the cover and melting the end of the leg to form a button to secure the leg to the cover, and cooling the button by means of a heat conducting die that may simultaneously shorten the cool down of the melted plastic button and emboss a design on the button.

18 Claims, 2 Drawing Sheets

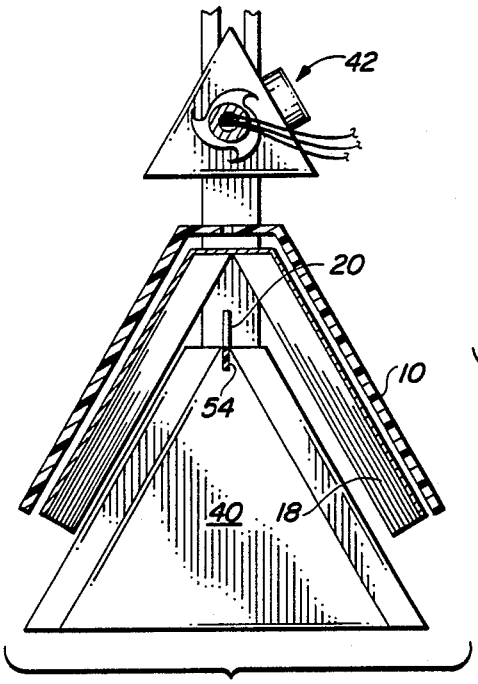
FIG. 6
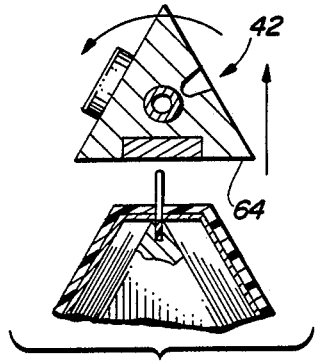
FIG. 7C
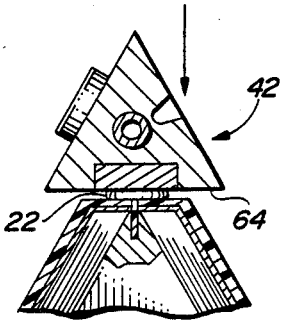
FIG. 7D
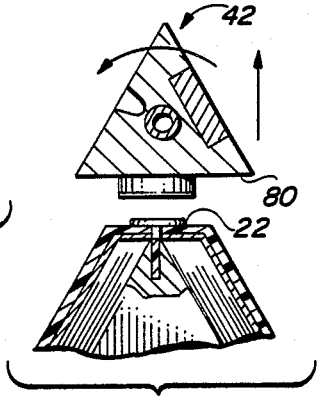
FIG. 7E
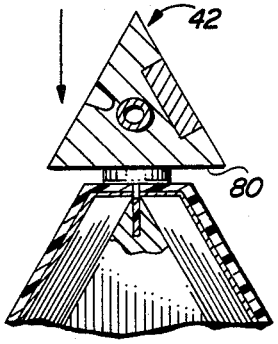
FIG. 7F
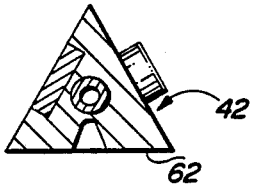
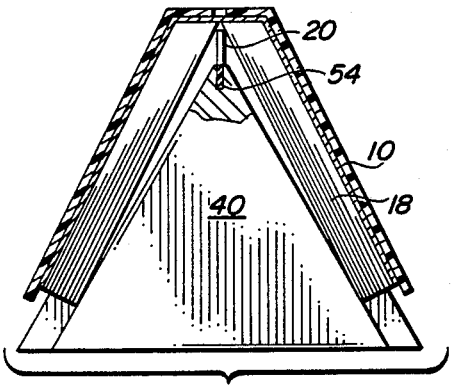
FIG. 7A
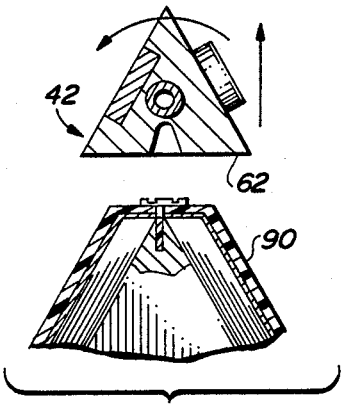
FIG. 7G
FIG. 8A
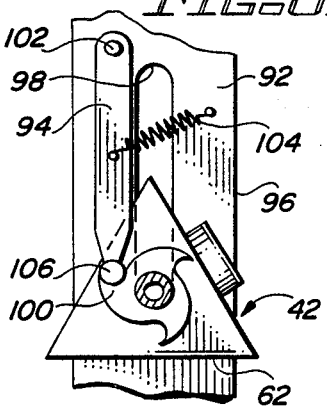
FIG. 8C
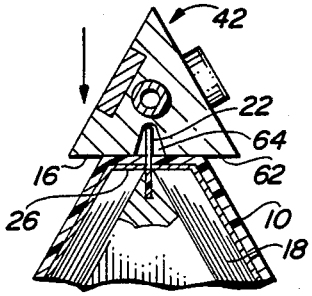
FIG. 7B
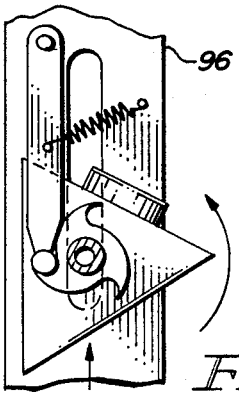
FIG. 8B
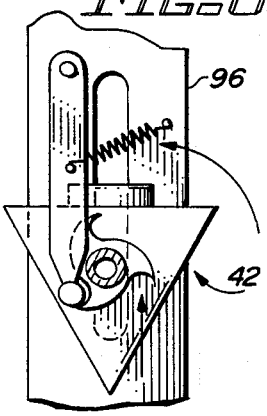

COVER BINDER SYSTEM

BACKGROUND OF THE INVENTION

Sheet metal binders, or holders, have been known for many years for binding catalogs, magazines and directories and other types of soft cover books to specially designed protective covers that are not provided by the original publisher. Such covers and binders are frequently utilized for public or office telephone directories, magazines on airplanes and waiting rooms, and a myriad of other applications.

These metal binders include an elongated base strip with upturned ends, one of which serves as the pivotal connection for a blade-like binder, the other of which releasably holds the free end of the binder in position. The base as well as the blade are sheet metal stampings and require separate stamping operations and an assembly step to connect the blade to the upstanding end portions of the base strip. The assembly of the binder is further complicated by the pivotal connection. For large quantity production, a significant cost savings would be provided if the manufacturing or assembly steps were reduced. An additional deficiency is that the metal binders tend to be awkward and heavy, due to the complexity of the design.

Many of these binding methods are slow and expensive and are often not adaptable to simple office equipment.

SUMMARY OF THE PRESENT INVENTION

In accordance with the present invention a cover binder is provided for binding books in a one piece protective cover. The book to be bound could include a book, a magazine, a catalog, a directory, or any other set of sheets previously bound, e.g., perfect, general or velo bindings, among others. The cover is one piece with two side portions and one center portion having at least one aperture. In addition to the cover, the cover binder has a one piece plastic strip with at least one leg adapted to pierce or pass through the spine of the book and register with the aperture in the cover. The leg is engaged by detent means to secure the plastic strip to the center portion of the cover.

In essence, the cover binder has only two simple pieces, the cover and the plastic strip. There is no need for a base strip or a pivotal connection. Manufacturing the components is a simple and inexpensive process.

As the strip is made of plastic, and the cover may be made out of any available material, the entire cover binder can be made far lighter in weight than other cover binders.

The material selected for the binder can be modified depending on the durability that the customer desires for the cover binder. Costs are minimized by avoiding materials that are more sturdy than necessary.

The present invention involves also a method and an apparatus for binding books with the above described cover binder. The method includes pressing the legs of the plastic strip through the spine of a book from the inside out, next placing the ends of the legs through the apertures of the cover, and then securing the legs into place, e.g., melting the plastic ends to a button, to keep them from withdrawing from the apertures and the book.

An important feature of the method is the use of a heat conductive die, e.g., aluminum, copper or the like to cool the melted plastic ends, thereby reducing the cooling step from about 30 to 45 seconds to 3 seconds.

Because of the simplicity of the method for binding books, the apparatus for practicing the method is also uncomplicated. Included in the apparatus is a base having positioning means for holding in place the plastic strip with its leg or legs (leg means) extending upward. The book and the cover are then easily placed over the leg means. Also included is a apparatus for sequentially pushing the leg means of the plastic strip through the spine of the book and through the apertures of the cover. Finally, there is an apparatus for altering the ends of the leg means to secure it to the cover.

The method and apparatus of the present invention is adapted for use with a simple, desk-type piece of office equipment. Use of such equipment is relatively rapid and accommodates wide flexibility in the design of the treated book depending upon the choice of the customer. Also, the colors and design of the cover may be easily varied depending upon the taste of the customer.

In addition to being adapted for use with a simple, desk-type piece of office equipment, the binding is also adaptable to more sophisticated equipment involving repetitive operations and higher speeds. Thus, the strips may be assembled and packaged in cartridges to fit into a machine without the necessity of manually positioning each individual strip. Alternatively, the strips may be formed in coils of a length sufficient to bind a number of books. Such coils fit into the binding machine and are cut to length as required. The coils of plastic material may be fed into the machine manually or by mechanical means. Large number of books such as paper back books and magazines found in libraries may be readily bound this way to increase their useful life. Accordingly, although the present invention has a considerable advantage in that it is usable with very simple equipment; nevertheless, it is also adaptable to commercial production of covered books.

BRIEF DESCRIPTION OF THE DRAWINGS

In order that the invention may be understood, a description of the invention is provided herein with reference to the general concepts and an illustrative embodiment thereof, wherein:

FIG. 6 is a cross-section of a book and binder cover inserted on the binding apparatus;

FIGS. *7a–7g* depict a series of cross-sections of a book, binder cover and binding apparatus, illustrating the pressing, heating and embossing steps; and FIGS. 8*a*–8*c* are a series of enlarged views of the rotating mechanism of the press, heat and emboss unit of the binding apparatus.

DETAILED DESCRIPTION OF THE PREFERRED EMBODIMENT

Figure 1:
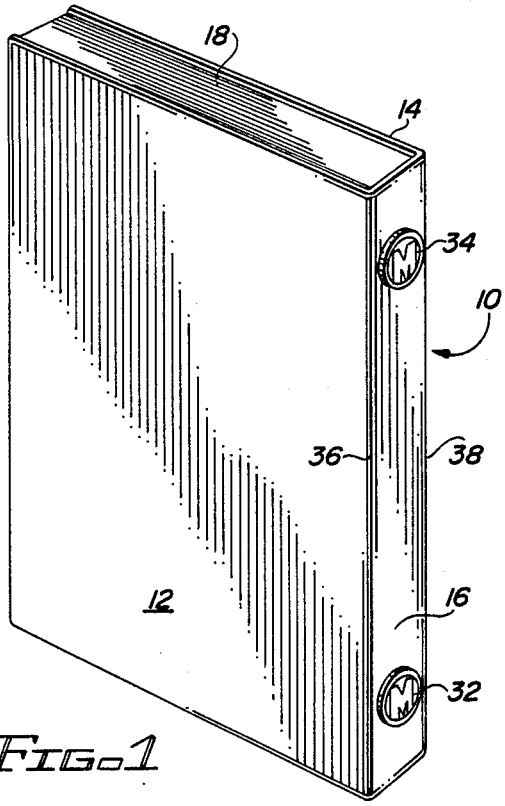
FIG. 1, is a perspective view of a book with the present binder holding the book to a protective cover.
Figure 1A:
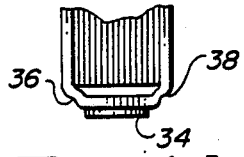
FIG. 1A is an enlarged, fragmentary view of FIG. 1, showing 36, 38 in detail.

Viewing FIG. 1, the present cover binder 10 with side portions 12 and 14 and center portion 16 illustrated in an exemplary application binding a book 18 in a specially designed protective cover 10, which may be constructed of plastic. In addition to its protective function, the cover 10 may also carry advertising and serve as a source of revenue.

Figure 2:
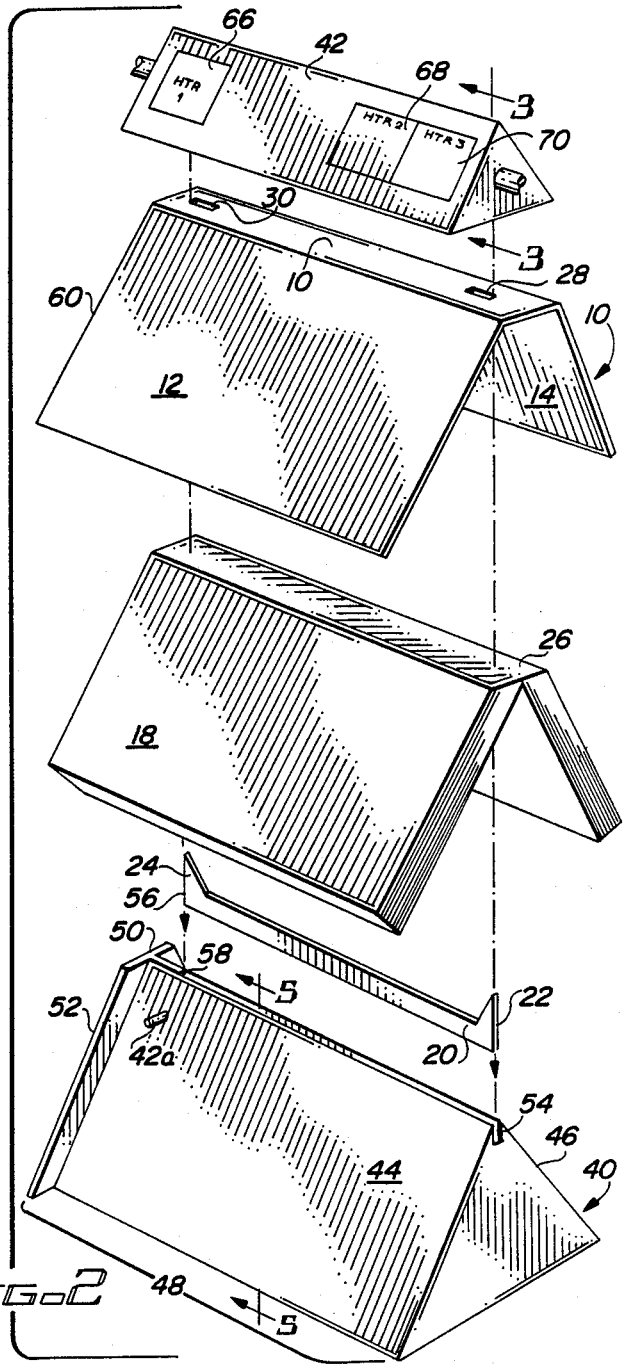
FIG. 2 is an exploded isometric view of a book and binder cover inserted on the binding apparatus.

The cover binder 10 generally includes a plastic strip 20, shown in FIG. 2, whose legs 22 and 24 are extended through the spine 26 of the book 18 and register with apertures 28 and 30, also shown in FIG. 2. The number of legs, one or more, can vary depending on the size of the book and the desired strength of the cover binder. The ends of legs 22 and 24 generally are secured to the center portion 16 of the cover 10. In the present embodiment, the ends are made into heat formed buttons 34 and 36 (FIG. 1) that have been embossed. The buttons are larger than the apertures thus preventing the legs from sliding out of the cover.

The entire cover 10, according to the presently preferred embodiment of the invention, is constructed of a one-piece cover 10. The flexible intersections 36 and 38 between the side portions 12 and 14 and the center portions 16 are formed by making the thermoplastic at the intersections substantially thinner, commonly referred to as a living hinge.

Now viewing FIG. 2, a book 18, binder 10 and plastic strip 20 are shown in relation to the parts of a binding apparatus 40 and 42. A triangular base 40 has two sides 44 and 46 of equal size. The two sides 44 and 46 of the base are large enough to accommodate books that have sides of the maximum desired length. Similarly, the length depicted by 48 of the base is long enough to accommodate the books with the maximum desired height. Extensions 50 and 52 perpendicular to the two sides are located at one end of the base 40. The extensions are used to align the book and the cover.

The top corner of the base 40 has a groove 54 having a rectangular cross-section. The groove does not extend along the entire length of the base, it ends just before the extensions 50 and 52 of the base. The plastic strip 20 is placed in the groove with one end 56 butted up against the end 58 of the groove with the legs 22 and 24 facing up. The ends of the legs 22 and 24 of the plastic strip 20 can easily pierce the book because they are sharply pointed. The preferred cross-section of the entire plastic strip 20 is rectangular to fit easily between the pages at the center of the book 18.

The book 18 is opened to substantially its center and is placed over the plastic strip 20. One end of the book 18 is butted up against the extensions 50 and 52 of the base 40. The cover 10 is then placed over the book 18. One end of the cover 10 is butted against the extensions 50 and 52 of the base 40 making sure that the apertures 28 and 30 are aligned with the legs 22 and 24 of the plastic strip 20. A press, heat and emboss unit 42 is located over the cover 10 in such a way that it can be raised and lowered over the center portion 16 of the cover. Removable pin **42*a* is provided to position the book relative a cover to allow some space between book and cover. The book 18 may be aligned with the cover 10 or inwardly of the cover 10 by means of pin 42*a***.

Figure 5:
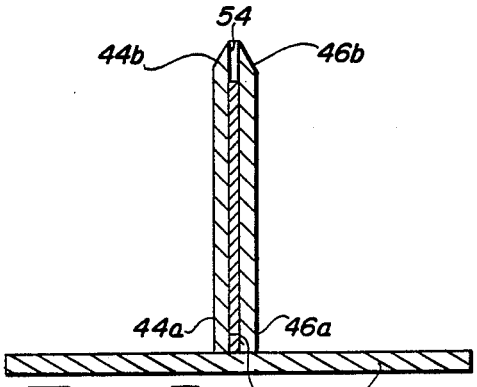
FIG. 5 illustrates a preferred, alternative embodiment of the base means of the binding apparatus, here shown in a cross section corresponding to the embodiment of FIG. 2 at 5—5.

FIG. 5 shows a preferred alternative embodiment wherein the two sides **44*a*, 46*a* of the base sandwich a spacer member 54*a*, all on a pedestal support 54*b*. The entire sandwich of 44*a*, 54*a* and 46*a* is only 3/16" wide. Sides 44*a* and 46*a* are chamfered at 44*b* and 46*b***. This embodiment is useful in handling certain kinds of books.

Figure 3:
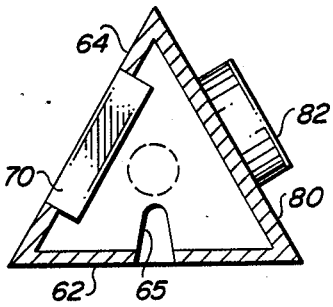
FIG. 3 is a cross-section taken generally along line 3—3 of FIG. 2 illustrating the press, heat and emboss unit of the binding apparatus.

The press, heat and emboss unit 42 has three sides, each of which is used to perform a different function. FIG. 3 shows a cross-section of the unit 42 taken along line 3—3 in FIG. 2. Side 62 is used to press the cover 10 and the book 18 onto the legs 22 and 24 so that the legs will pierce the spine 26 of the book and pass through the holes 28 and 30 of the cover 10. The press side 62 is flat except for a groove 65 in the center substantially along its length. The purpose of the groove is to allow space for the legs 22 and 24 after they have protruded through the apertures 28 and 30 of the cover 10 while enabling the unit to put pressure on each side of the legs.

Figure 4:
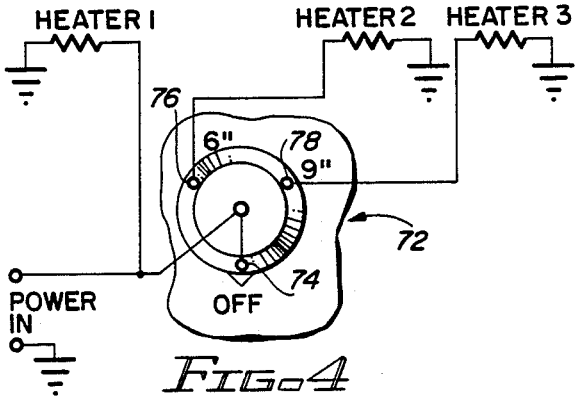
FIG. 4 is an enlarged view of the heating dial of the press, heat and emboss unit of the binding apparatus.

Side 64 of the unit is used to heat the ends of the legs 22 and 24. A heater 70 warms the surface of the heat side to a temperature high enough to melt the ends of the legs. In the embodiment shown in FIG. 2, three heaters 66, 68 and 70 are located along the length of the heat side. A first heater 66 is located 6" from a second heater 68, and a third heater 70 is 9" from the first heater 66. This configuration can be used to heat ends of legs that are 6" or 9" apart. The dial 72 used in the present embodiment is shown in FIG. 4 and can be set at three different positions. In the off position 74, none of the heaters are on. At the 6" position 76, the first and second heaters are on. At the 9" position 78, the first and third heaters are on. The heater side and dial can be adapted so that heaters (not shown) are placed continuously along the length of the side allowing for more variation on the location and number of legs that can be heated.

The third side of the unit is the emboss side 80. Molds 82 are used to form the shape and design of the button after the leg ends have been melted. The molds are removable and can be replaced with molds having various patterns. The molds can be placed at different locations along the emboss side 80 of the unit allowing for variation on the location and number of legs that can be embossed.

FIG. 7 is a series of views showing the steps of the cover binding process. FIG. 7A shows the plastic strip 20 that has been inserted into the groove 54 of the base 40 with the book 18 and the cover 10 placed over the groove. Here, the press, heat and emboss unit 42 is raised high enough above the base 40 to facilitate placing the plastic strip, book and cover in place.

Moving to FIG. 7B, the press, heat and emboss unit 42 with press side 62 facing downward is pressing against the center portion 16 of the cover 10. The leg 22 has pierced the spine 26 of the book 18 and passed through the aperture in the cover 10.

In FIG. 7C, the press, heat and emboss unit 42 has been lifted off the cover and rotated counterclockwise so that the heat side 64 is now facing downward. As shown in FIG. 7D, the heat side 64 is then lowered toward the ends of the legs, close enough to melt the ends of the legs 22.

FIG. 7E shows the press, heat and emboss unit 42 being lifted off of the melted ends of the legs 22. The unit is again rotated counterclockwise so that the emboss side 80 is facing downward.

In the view of FIG. 7F, the emboss side 80 is lowered onto the melted ends of the legs to form an embossed button and cool the legs 22. The embossing in relation to the cooling step is an important feature because it shortens the time for cooling the melted plastic from as much as 45 seconds to about 3 seconds.

The final step is shown in FIG. 7G. Here, the press, heat and emboss unit 42 is again raised to its starting position to accommodate removal of the now covered and bound book 90. The press, heat and emboss unit 42 is also rotated counterclockwise to its starting position with the press side 62 down to be ready to repeat the process.

The rotating mechanism is shown in a series of views in FIG. 8. The mechanism may be carried by any suitable frame such as 96, here shown in part, and may be mechanized or hand operated. The press, heat and emboss unit 42 is positioned between two appendages 92 and 94 of a holder 96. The first appendage 92 of the holder 96 has an aperture 98. A pin (not shown) is fixed in one end of the press, heat and emboss unit and is inserted in the aperture 98. The pin can move freely up and down within the aperture 98.

Attached to the other end of the press, heat and emboss unit 42 is a fixture 100. The fixture 100 is secured and cannot rotate in relation to the press, heat and emboss unit. The fixture 100 is shaped such that when any given side of the press, heat and emboss unit is facing downward, it will not rotate unless force is applied.

The second appendage 74 of the holder 96 is attached to the first appendage 92 at one end 102 with a cross member (not shown). The first and second appendages are also attached to a spring 104. One end 106 of the second appendage 94 of the holder is rounded to allow it to move freely along the edge of the fixture 100 attached to the end of the unit.

The first view, FIG. 8A, shows the press, heat and emboss unit 42 with the press side 62 facing downward and locked in place. As the press, heat and emboss unit 42 is forcibly rotated counterclockwise, it slides upward within the holder 96 as shown in FIG. 8B. FIG. 8C shows that the press, heat and emboss unit 42 continues to slide upward within the holder 96 as it is further rotated counterclockwise. When the press, heat and emboss unit has been rotated enough for the heat side to be facing downward, it is at is lowest position in relation to the holder and is again locked in place.

What is claimed is:

1. A bound book comprising:

a cover comprising a center portion having at least one aperture;

a book, having pages and a spine, disposed within said cover;

a plastic strip disposed within the pages of said book and having at least one leg extending from said strip through the spine of said book and through said aperture, said leg having a melted end forming a detent means;

whereby said cover is bound to said book by means of said plastic strip, leg and detent means.

2. The bound book of claim 1 wherein said detent means comprises a button larger than said aperture.

3. The combination as defined in claim 1, wherein said cover is formed of an integral piece of thermoplastic material.

4. The combination of claim 1, further comprising a flexible connection at the intersections of said side portions and said center portion of said cover.

5. The combination of claim 1, wherein said detent means comprises a formed button at the end of said leg that is larger than said apertures on said cover.

6. The combination of claim 5, wherein said button is embossed.

7. The combination of claim 1, wherein said plastic strip has a plurality of spaced legs.

8. The combination of claim 1, wherein said plastic strip and said leg are rectangular in cross section.

9. A binding apparatus for manufacturing the bound book of claim 1 comprising:

base means for holding said plastic strip over which a book and said cover can be placed;

pressing means for pushing said legs of said plastic strip through the spine of a book from the inside out and through said apertures of said cover; finishing means for melting the ends of said legs to lock them into place whereby the ends are secured to said cover.

10. The combination as defined in claim 9, wherein said finishing means comprises a heating means for melting said ends of said legs to form a button that is larger than said apertures on said cover.

11. The combination as defined in claim 10, wherein said heating means is adapted to engage legs of varying number and spacing.

12. The combination as defined in claim 10, wherein said pressing means and said heating means are contained in one press and heat unit.

13. The combination as defined in claim 12, further comprising a rotating means for revolving said press and heat unit whereby said press and heat unit is moved between a pressing position and a heating position.

14. The combination as defined in claim 10, further comprising an embossing means for cooling the melted plastic and forming a decorative button.

15. The combination as defined in claim 14, wherein said heating means is adapted to engage legs of varying number and spacing.

16. The combination as defined in claim 14, wherein said pressing means, said heating means and said embossing means are contained in one press, heat and emboss unit.

17. The combination as defined in claim 16, further comprising a rotating means for revolving said press, heat and emboss unit whereby said press and heat unit is moved between pressing position, a heating position and an embossing position.

18. The combination as defined in claim 16, wherein said press, heat, emboss unit has a triangular cross section.

* * * * *